United States Patent [19]

Siefert

[11] 4,228,533

[45] Oct. 14, 1980

[54] AUTONOMOUS PENDULUM MECHANISM FOR CLOCKWORKS

[75] Inventor: Roland Siefert, Bad Durrheim, Fed. Rep. of Germany

[73] Assignee: Kienzle Uhrenfabriken GmbH, Schwenningen, Fed. Rep. of Germany

[21] Appl. No.: 23,365

[22] Filed: Mar. 23, 1979

[30] Foreign Application Priority Data

Apr. 1, 1978 [DE] Fed. Rep. of Germany ... 7809694[U]

[51] Int. Cl.[3] ..... G04B 15/00; G04B 17/02; G04B 37/00

[52] U.S. Cl. ..... 368/134; 368/179; 368/278

[58] Field of Search ..... 58/129, 131, 132, 29, 58/30, 31, 32

[56] References Cited

U.S. PATENT DOCUMENTS

| | | | |
|---|---|---|---|
| 4,043,118 | 8/1977 | Haag et al. | 58/129 |
| 4,073,130 | 2/1978 | Jauch | 58/9 |

*Primary Examiner*—Vit W. Miska

*Attorney, Agent, or Firm*—Pollock, Vande Sande & Priddy

[57] ABSTRACT

An autonomously operating pendulum mechanism, adapted to be attached as a unit to a clockwork, comprises a supporting plate adapted to be attached to a clockwork casing in overlying spaced relationship to the front face of the casing. The supporting plate is fastened to the casing by a fastening device which is concentric with the spindles for the clock hands and through which said spindles may project to the exterior of the plate. A pivot bearing is provided on the supporting plate vertically above the spindles adjacent the upper edge of the casing, and the lower edge of the supporting plate carries a circuit board having an electrically energizable coil thereon located immediately below the clockwork casing comprising a portion of an electrical drive mechanism. A pendulum arm extends from the pivot bearing for swinging motion across the front face of the casing in the region between the supporting plate and casing, and has, at its lower end, a permanent magnet which cooperates with the coil to drive the pendulum. The pendulum arm is shaped to define two portions which are disposed in angular relation to one another so that the upper portion of the arm swings in a limited region between the clockwork spindles and one side of the clockwork casing while the lower portion of the arm below the spindles swings between points which are substantially equidistant from the opposite sides of the clockwork casing.

12 Claims, 2 Drawing Figures

AUTONOMOUS PENDULUM MECHANISM FOR CLOCKWORKS

BACKGROUND OF THE INVENTION

The present invention relates to a pendulum mechanism, adapted to be attached to the casing of a clockwork for use together with the clockwork, which operates independently of the clockwork, and which comprises a pivot bearing, a pendulum arm mounted on the bearing for swinging motion, and an electrical drive mechanism for the pendulum comprising a permanent magnet carried by the pendulum adjacent its lower end and cooperating with a coil mounted on a circuit board located below the clockwork casing and carrying the electronics for driving the pendulum.

An autonomously operating pendulum arrangement, which can be attached to a crystal-controlled clockwork, is discussed in Haag et al U.S. Pat. No. 4,043,118, assigned to the assignee of the instant application. This known arrangement consists of a pendulum housing adapted to be fastened to the lower side of the clockwork casing and carrying a circuit board on which are mounted the electrical components required to drive the pendulum. The arrangement includes a bearing device for the pendulum arm which bearing device is attached as a separate element to the upper side of the clockwork casing, and a device for suspending the pendulum is provided at the lower side of the pendulum arm. The housing is also provided with a lateral arm on which the bell of a clock-striking system can be mounted.

This known arrangement has the disadvantage that the proper functioning of its various components, i.e., the overall pendulum arrangement as well as the associated chime system, can be checked out for proper operation only when all of the separate parts of the pendulum have been assembled on the clockwork casing. There is, in addition, the disadvantage that the pendulum arm is substantially U-shaped and envelopes the clockwork laterally, and this requires a comparatively large amount of space for the swinging motion of the pendulum. The known arrangement, moreover, cannot be used in conjunction with comparatively small pendulum clocks, for example table clocks; and the lateral placement of the bell of the clock-striking system precludes use of the arrangement in small-sized classic clocks.

The present invention is intended to obviate these disadvantages of the prior art, and is concerned with a novel autonomous pendulum mechanism which can be connected to the casing of the clockwork in the form of a completely separate assembled structural unit whose functioning can be checked out independently of the clockwork. Moreover, the unitary pendulum mechanism of the present invention is so arranged that a chiming system can be incorporated therein as part of the pendulum unit, so that its proper operation can also be checked out independently of the clockwork.

SUMMARY OF THE INVENTION

The present invention relates to a pendulum mechanism, for use with a clockwork of the type comprising a clockwork casing the front face of which has spindles thereon for the clock hands, and which pendulum mechanism is adapted to be attached as a unit to the clockwork for operation independently of the clockwork. The pendulum mechanism comprises a supporting structure, preferably taking the form of a vertical supporting plate of generally U-shaped configuration in both its horizontal and vertical cross sections, which is adapted to be attached to the clockwork casing in outwardly spaced relation to the front face thereof, and in overlying relation to the top, bottom, and both side edges of the clockwork casing.

The inwardly extending leg of the supporting plate, adjacent the top of the clockwork casing, has a pivot bearing thereon from which a pendulum arm can be suspended for swinging motion in the region between the inner surface of the supporting plate and the front face of the clockwork casing. The inwardly extending leg at the bottom of the supporting plate has a circuit board mounted thereon which includes an electrically energizable coil that cooperates with a permanent magnet carried by the lower end of the pendulum arm for driving the pendulum arm in a swinging motion. Such electrical drive mechanisms are known per se and are accordingly not described in detail.

The pendulum arm is of special shape, and comprises a first portion adjacent the upper end of the arm which extends downwardly from the pivot bearing at an angle to the line between the pivot bearing and the clockwork spindles into the region between said spindles and one side of the clockwork casing, and a second portion which is angled in the direction opposite to that of said first portion and which extends downwardly from the lower end of the first portion to a position below the lower end of the supporting plate. The dimensions and angular orientations of the two portions of the pendulum arm are such that the swinging motion of the first or upper portion of the pendulum arm across the front face of the clockwork casing occurs entirely in the region between the spindles and one side of the clockwork casing, while the lower end of the second portion of the pendulum arm swings between points which are substantially equidistant from the opposite sides of the clockwork casing in the region below the spindles. As a result, the lower end of the pendulum arm, which is the only portion visible when the pendulum mechanism is mounted on the clockwork casing, swings uniformly across the casing from a pivot point which is located on the supporting plate adjacent the top of the casing without, however, any interference between the swinging pendulum arm and the spindles for the clock hands.

The pendulum mechanism may further include a chiming system as an integral portion thereof. In the preferred embodiment of the invention, the chiming system comprises a bell which is mounted on the inwardly extending leg of the supporting plate immediately above the top edge of the clockwork casing, a clapper which is pivotally mounted on the supporting plate and which cooperates with a return spring for striking the bell, and a cam arrangement for driving the clapper and comprising a pinion which extends from a cam into mesh engagement with a portion of the clockwork through an opening in the clockwork casing.

BRIEF DESCRIPTION OF THE DRAWINGS

The foregoing objects, advantages, construction and operation of the present invention will become more readily apparent from the following description and accompanying drawings in which.

DESCRIPTION OF THE PREFERRED EMBODIMENTS

Figure 1:
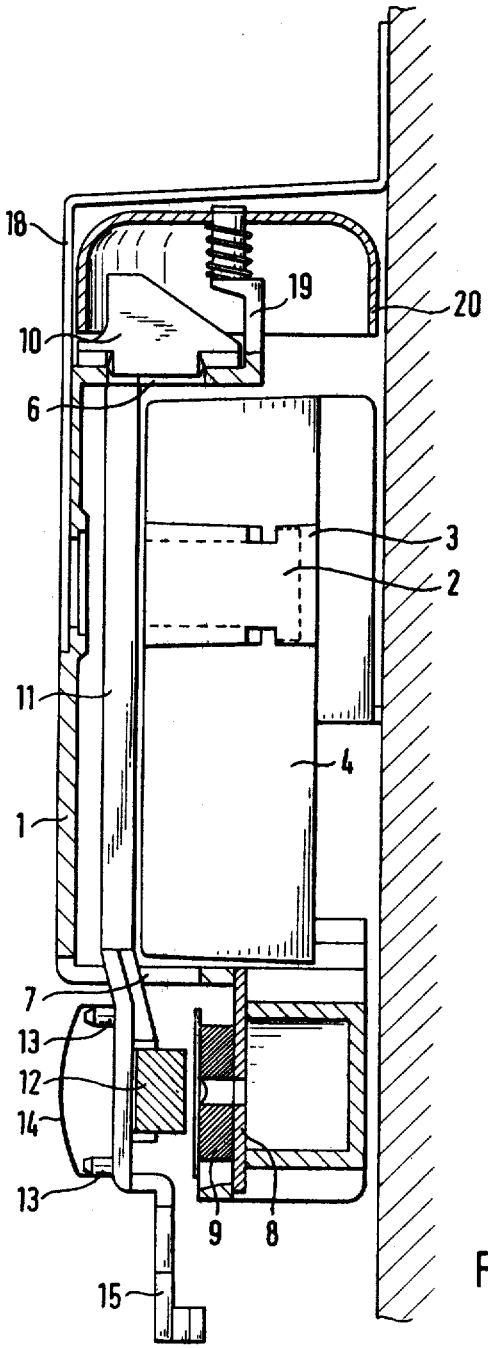
FIG. 1 is a side cross-sectional view of a pendulum mechanism constructed in accordance with the present invention and mounted on a clockwork casing.

Referring to the drawings, like numerals of which refer to like parts throughout, the entire pendulum mechanism, including the chiming system which forms an optional portion thereof, is mounted on a supporting plate 1 adapted to be generally vertically disposed adjacent the front face of a clockwork casing 4 in outwardly spaced relation to said front face to provide an intervening region in which a pendulum arm 11 may swing. The supporting plate 1 carries a pair of laterally spaced inwardly extending locking arms 2 which are adapted to engage corresponding locking notches 3 on the vertical side edges of the clockwork casing 4; and said supporting plate 1 further includes a central fastening device 17 disposed in concentric relation to the clock hands spindles (not shown) of the clockwork, and through which the spindles may project to the outer side of the supporting plate 1 for cooperation with a clock face (not shown) which may also be fastened, by means of said fastening device 17, to the outer side of the supporting plate 1. A suspension arm 18, having the double angular bends best shown in FIG. 1, can also be connected to the central fastening device 17 to hang the clock and associated pendulum mechanism from a wall. The suspension arm 18 is not employed when the arrangement of the present invention is utilized in conjunction with upright standing clocks.

The supporting plate has a generally U-shaped configuration in horizontal cross section, providing inwardly extending edges 5 which engage the front side of the clockwork casing 4 when the supporting plate 1 and casing 4 are locked together. The supporting plate 1 also exhibits a U-shaped configuration in vertical cross section, to provide an inwardly extending upper leg which partially overlaps the upper edge of casing 4 and which forms a pivot bearing 6 for the pendulum arm 11. The lower inwardly extending leg 7 of the plate 1 carries a circuit board 8 comprising inter alia, an electrically energizable coil 9 which cooperates with a permanent magnet 12 affixed to the lower end of pendulum arm 11 to drive the pendulum arm in a swinging motion. Such electrical drive mechanisms are known per se, and their detailed construction and operation will therefore not be further described herein.

Figure 2:
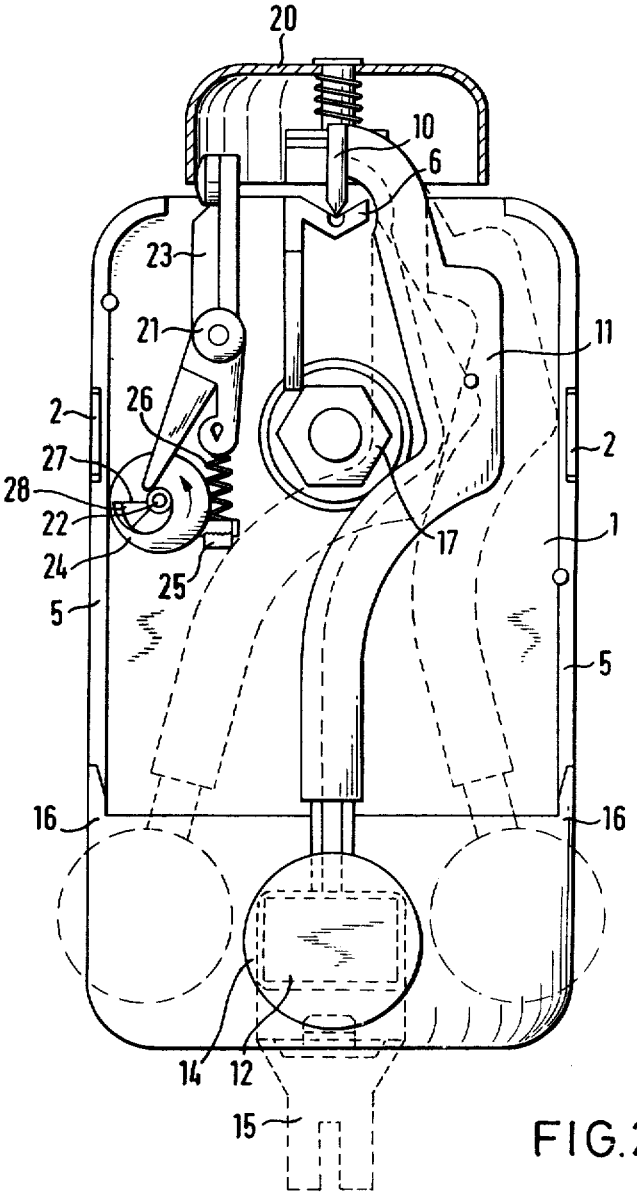
FIG. 2 is a rear view of the pendulum mechanism of the present invention.

Inserted into the pivot bearing 6 is a rocker joint 10 which is affixed to the upper end of pendulum arm 11. As best shown in FIG. 2, the pendulum arm 11 extends downwardly from rocker joint 10 in a unique configuration, and comprises an upper portion which is oriented at an angle to the line between the pivot bearing 6 and the clockwork spindles (or center of fastening device 17) into the region between said spindles and one side of the clockwork casing so that when the pendulum arm swings between its extreme positions (shown in broken line in FIG. 2) the swinging motion of the upper portion of the pendulum arm 11 across the front face of the clockwork casing 4 is confined to a region between the clockwork spindles and one side of the clockwork casing 4. The lower portion of the pendulum arm is angled in the direction opposite to that of the upper portion thereof, and preferably exhibits the smoothly curved configuration shown in FIG. 2 so that the lower end of the pendulum arm is disposed directly below the clockwork spindles in the rest position of the pendulum and so that, when the pendulum is swinging, the lower end of the pendulum arm 11 swings across the front face of the clockwork casing between points which are substantially equidistant from the opposite sides of the clockwork casing 4 in the region below said spindles. By reason of this generally U-shaped or V-shaped configuration of the pendulum arm 11, the pendulum arm effectively envelops the clock hand spindles and is adapted to exhibit a desired swinging motion from across the front face of the clockwork casing a pivot point adjacent the upper side of the clockwork casing without, however, interfering in any way with the spindles which project outwardly from said front face of the clockwork casing.

The lower end of the pendulum arm 11 may be provided with two molded pins onto which a pendulum lens or disc 14 may be plugged in overlying covering relation to permanent magnet 12, to conceal the permanent magnet. In addition, if desired, the lower end of the pendulum arm 11 can be provided with a hanger device 15 for the suspension of a pendulum extension (not illustrated). If the pendulum mechanism is to be used for a classic clock, and the disc 14 is plugged into place at the lower end of arm 11, the hanger device 15 is not used and is simply removed. The lower leg 7 of supporting plate 1 is attached to the vertical portion of said supporting plate only at the laterally spaced points 16, and defines a slot between points 16 through which the lower portion of the pendulum arm may extend for swinging motion.

The supporting plate 1 also carries a complete chime system. More particularly, a vertical fastening arm 19 is mounted adjacent the center of the upper inwardly extending leg of supporting plate 1 to the rear of pivot structure 6, 10, and is adapted to support a bell 20 thereon adjacent the top of the clockwork casing 4. Two pillowblock bearings 21, 22 are provided on the vertical interior side of supporting plate 21, and a clapper 23 is mounted on bearing 21 while a cam 24 is mounted on bearing 22. A hook structure 25 is also provided on the inner side of support plate 1, and a spring 26 extends between said hook device 25 and an arm of the clapper 23 for returning the clapper 23 to its quiescent position (shown in FIG. 2). The clapper 23 is provided with a further arm which extends into engagement with the cam 24 so that, as the cam 24 rotates, the clapper 23 may be displaced from its quiescent position against restraint of spring 26.

Cam 24 is provided with a pinion (not shown) which mesh engages an appropriate portion of the clockwork in casing 4 through an opening in said clockwork casing. The clockwork is operative to cause the cam 24 to rotate in the direction shown by the arrow in FIG. 2, so that the clapper 23 is gradually moved away from the bell 20 while the spring 26 is being cooked. When, during this rotation of the cam, the releasing edge 27 of the cam is reached, the angularly inclined arm of clapper 23 drops free and the clapper is pulled by spring 26 back to the position shown in FIG. 2, causing the clapper to strike bell 20.

In order to allow the cam 24 to turn in a rearward direction across the releasing edge 27 when the clock hands are being set back, the cam 24 is provided with an inclined surface 28 which starts at the releasing edge 27 so that the arm of the clapper 23 is appropriately guided onto the cam profile of cam 24 during reverse motion thereof.

As illustrated in the drawings, the pendulum mechanism of the present invention can be constructed with comparatively small dimensions, making it suitable for use in small size classic clocks. The point of pivotal mounting for the pendulum, and the shape of the pendulum arm, provide space-saving advantages and, in addition, the overall mechanism is adapted to incorporate a chiming mechanism in an arrangement wherein the bell thereof is visible at the top of the clock. In the case of small sized pendulum clocks, moreover, the present arrangement permits the pendulum disc or lens 14 to be located close to the clock face, which substantially improves the appearance of the clock in comparison with known mechanically operated classic clocks. Finally, the overall arrangement permits the overall clock to be divided into two completely separate units, namely the clockwork itself and the pendulum mechanism, and a chiming system which may be optionally included in the latter, so that these separate autonomous units can be checked independently for proper operation.

Having thus described my invention, I claim:

1. For use with a clockwork of the type comprising a clockwork casing the front face of which has spindles thereon for the clock hands, a pendulum mechanism adapted to be attached as a completely assembled unit to said clockwork casing and operative independently of said clockwork, said pendulum mechanism comprising a generally vertical supporting plate adapted to be attached to said clockwork casing in overlying spaced relation to the front face of said casing, said supporting plate having a pivot bearing thereon which is located vertically above said spindles when said pendulum mechanism is attached to said clockwork casing, a pendulum arm having an upper end mounted for pivotal motion in said bearing, said arm depending vertically downward from said pivot bearing across the rear side of said supporting plate for swinging motion across the front face of said clockwork casing in the space between said supporting plate and the front face of said casing, said arm in the direction of its extension being of generally V-shape and comprising a first portion which extends across the front face of said clockwork casing downwardly from said pivot bearing at an angle to the line between said pivot bearing and said spindles into the region between said spindles and one side of the clockwork casing and a second portion which is angled in a direction opposite to that of said first portion and extends across the front face of said clockwork casing downwardly from said first portion, whereby the swinging motion of said first portion across the front face of said clockwork casing when said pendulum mechanism is attached to said clockwork casing occurs entirely in the said region between said spindles and said one side of said clockwork casing while the lower end of said second portion swings across the front face of said clockwork casing between points which are substantially equidistant from the opposite sides of said clockwork casing in the region below said spindles, and an electrical drive mechanism in said pendulum mechanism adjacent the lower end of said second portion for effecting swinging motion of said pendulum arm, said drive mechanism comprising a permanent magnet carried by one of said supporting plate and said second portion, and an electrically energizable coil carried by the other of said supporting plate and second portion.

2. The pendulum mechanism of claim 1 including means for removably attaching said plate to said supporting clockwork casing, said pivot bearing being mounted on said plate adjacent its upper end at a location above the upper edge of said clockwork casing, and a portion of said electrical drive mechanism being carried by the lower end of said plate at a location below the lower edge of said clockwork casing.

3. The pendulum mechanism of claim 2 wherein said attachment means comprises at least one arm extending from said plate for fastening engagement with a vertical exterior side of said clockwork casing.

4. The pendulum mechanism of claim 1 wherein said supporting plate is of generally U-shaped configuration in horizontal cross-section and defines a pair of inwardly extending side edges which engage the opposite vertical sides of said clockwork casing.

5. The pendulum mechanism of claim 1 wherein said supporting plate is of generally U-shaped configuration in vertical cross-section and defines an inwardly extending upper leg which overlies the top of said clockwork casing and an inwardly extending lower leg which overlies the bottom of said clockwork casing, said lower leg including a horizontally extending slot therein through which said second portion of said pendulum arm extends for swinging motion.

6. The pendulum mechanism of claim 1 including further fastening means on said supporting plate for fastening said plate and a clock face to said clockwork casing in concentric relation to said spindles.

7. The pendulum mechanism of claim 6 including a suspension arm connected to said supporting plate for hanging said clockwork on a wall.

8. The pendulum mechanism of claim 1 wherein said permanent magnet is carried by the lower end of said second portion, and means adjacent the lower end of said second portion of said pendulum arm for fastening a pendulum disc to said second portion in covering relation to said permanent magnet.

9. The pendulum mechanism of claim 1 including means adjacent the lower end of said second portion of said pendulum arm for fastening a pendulum extension to said second portion.

10. The pendulum mechanism of claim 2 including a chime system carried by said supporting plate, and means for engaging said chime system with the clockwork in said clockwork casing to effect operation of said chime system.

11. The pendulum mechanism of claim 5 wherein said upper leg of said supporting plate has a bell mounted thereon, a clapper mounted on said supporting plate adjacent said bell, and cam means responsive to operation of said clockwork for effecting movement of said clapper relative to said bell.

12. The pendulum mechanism of claim 11 wherein said clapper is pivotally mounted on said supporting plate, spring means carried by said supporting plate for urging said clapper toward a predetermined position, said cam means comprising a cam mounted for rotation on said supporting plate in engagement with said clapper and a pinion extending from said cam and adapted to mesh engage a portion of said clockwork through an opening in said clockwork casing, said cam being operative, as it rotates, to move said clapper away from its said predetermined position against the force of said spring means and, at a point in its rotation, to release said clapper thereby to permit said spring means to restore said clapper to its said predetermined position and thereby strike said bell.

* * * * *